US007814821B2

(12) United States Patent
Chenel

(10) Patent No.: US 7,814,821 B2
(45) Date of Patent: Oct. 19, 2010

(54) DELIVERY DEVICE FOR MINERAL WATER BOTTLE COUNTER CHARGES

(75) Inventor: Joseph Michel Donald Chenel, Fredericton (CA)

(73) Assignee: Her Majesty the Queen in right of Canada as represented by the Solicitor General of Canada, Ottawa (CA)

( * ) Notice: Subject to any disclaimer, the term of this patent is extended or adjusted under 35 U.S.C. 154(b) by 1118 days.

(21) Appl. No.: 11/221,942

(22) Filed: Sep. 9, 2005

(65) Prior Publication Data

US 2007/0236030 A1 Oct. 11, 2007

Related U.S. Application Data

(60) Provisional application No. 60/610,200, filed on Sep. 16, 2004.

(51) Int. Cl.

| | |
|---|---|
| ***F42B 33/00*** | (2006.01) |
| ***F42B 1/00*** | (2006.01) |
| ***F42B 39/00*** | (2006.01) |
| ***B65D 75/00*** | (2006.01) |
| ***B65D 77/00*** | (2006.01) |
| ***B65D 5/00*** | (2006.01) |
| ***B65D 5/46*** | (2006.01) |
| ***B64D 1/04*** | (2006.01) |
| ***F41F 5/00*** | (2006.01) |

(52) U.S. Cl. ..... 89/1.13; 206/139; 206/216; 206/3; 102/305; 229/115; 229/117.25; 86/50

(58) Field of Classification Search ..... 206/200, 206/174, 170, 427, 428, 162, 139, 216, 217, 206/3; 294/159, 165, 137, 32; 229/115, 229/117.11, 117.24, 117.25; 86/50; 102/305, 102/302; 211/72, 73; 89/1.13
See application file for complete search history.

(56) References Cited

U.S. PATENT DOCUMENTS

| | | | | | |
|---|---|---|---|---|---|
| 2,345,567 | A | * | 4/1944 | Arneson | 206/176 |
| 2,396,473 | A | * | 3/1946 | Powell | 206/170 |
| 2,441,134 | A | * | 5/1948 | Brogden et al. | 206/142 |
| 2,723,067 | A | * | 11/1955 | Fretz | 294/152 |
| 3,428,235 | A | * | 2/1969 | Randazzo | 206/427 |
| 3,700,160 | A | * | 10/1972 | Farrell | 229/117.25 |
| 4,051,993 | A | * | 10/1977 | Castoldi, Jr. | 229/115 |

(Continued)

FOREIGN PATENT DOCUMENTS

| | | | |
|---|---|---|---|
| CA | 2146264 | | 4/1994 |
| CA | 2257459 | | 12/1997 |
| FR | 2663296 | A1 * | 12/1991 |

*Primary Examiner*—Mickey Yu
*Assistant Examiner*—Melissa L Lalli
(74) *Attorney, Agent, or Firm*—Dowell & Dowell, PC

(57) ABSTRACT

The invention relates to a delivery device designed to carry Mineral Water Bottle (MWB) counter charges, by remote means, to a target Improvised Explosive Device (IED) during render-safe procedures. The delivery device is die-cut as a blank and folded into the desired form. The device includes at least one elongated tubular holding element for receiving a MWB counter charge with a lifting strap attached thereto that can easily be grasped by any remote means. The device is designed in such a way so as to provide automatic positioning of the MWB counter charges at the appropriate stand-off distance in relation to the IED. As well, the delivery device is fully collapsible so as to facilitate the storage and transportation of the device, and provides a quick and user-friendly system that facilitates the deployment of MWB counter charges.

9 Claims, 6 Drawing Sheets

U.S. PATENT DOCUMENTS 4,218,086 A * 8/1980 Klygis ..... 294/87.2
4,250,992 A 2/1981 Gilbert
4,305,500 A * 12/1981 Jaeschke ..... 206/153
4,607,784 A * 8/1986 Calabrese ..... 229/115
5,570,834 A * 11/1996 Larson et al. ..... 229/117.11
6,269,725 B1 * 8/2001 Cherry ..... 86/50
6,273,278 B1 * 8/2001 Enyedy et al. ..... 211/85.4
6,584,908 B2 * 7/2003 Alford ..... 102/302
6,615,984 B2 * 9/2003 Saulas et al. ..... 206/427
6,926,196 B2 * 8/2005 Testerman et al. ..... 229/198.2
7,134,375 B2 * 11/2006 Fish, Jr. ..... 86/50
7,347,326 B2 * 3/2008 Baechle ..... 206/453
2004/0112241 A1 * 6/2004 Alford ..... 102/364

* cited by examiner

DELIVERY DEVICE FOR MINERAL WATER BOTTLE COUNTER CHARGES

CROSS-REFERENCE TO RELATED APPLICATIONS

This application claims the benefit of provisional patent application No. 60/610,200 of Sep. 16, 2004.

FIELD OF THE INVENTION

The present invention relates to the disposal of Improvised Explosive Devices (IED) using Mineral Water Bottle (MWB) counter charges.

BACKGROUND OF THE INVENTION

Mineral Water Bottle counter charges are used to disrupt Improvised Explosive Devices by delivering a liquid, propelled by explosives, towards a target IED. To create the counter charge, the Mineral Water Bottle is equipped with a plastic tube inserted through the cap of the bottle. The tube is approximately 30 cm in length and sits on the bottom of the MWB. Explosive material such as DetCord™, C-4, DetaSheet™ or any other suitable material is used as the main charge. The main charge is inserted in the plastic tube, and depending on the density of the target IED, the charge can be enhanced by wrapping additional explosive material on the outside perimeter of the tube. The tube is preferably centered in the MWB to ensure that a similar volume of liquid is distributed to the target.

Detonator(s) are utilised as the primary initiation method and are usually activated via an electric charge by either remote means or by being hooked directly to a blasting machine. Alternatively, non-electric (i.e. shock tube initiated) detonators may be used. The detonators are placed on top of the main charge inside the plastic tube and are either initiated via command wire or by remote means. Detonation of the explosive charge propels the liquid from the MWB at such a pressure and velocity that the IED is neutralized and the area is rendered safe. Depending on the amount and type of explosives that are used to detonate the MWB counter charges, the pressure applied to the target IED can reach 18,000 lbs/in$^2$. MWB counter charges are known to be a very effective and efficient method of disrupting Improvised Explosive Devices.

However, the use of MWB counter charges is often complicated by the fact there is no universal system in place to facilitate the delivery of the counter charges to the target IED. As well, the use of MWB counter charges can be hazardous due to the fragmentation of material that results once the counter charge is detonated. Numerous techniques are currently used, but the delivery of the counter charges has always been problematic for various reasons.

For instance, having a person place the MWB counter charges at the appropriate stand-off distance from the target IED can be a time consuming procedure since the person must be suited up in the appropriate safety gear. As well, it can be difficult to quickly determine the proper positioning of the counter charges in relation to the IED. Furthermore, despite the safety gear and standard safety procedures, there is always a risk to the individual who is required to come into close proximity with the IED.

Robotic devices are known in the field and are often used in situations involving potentially dangerous devices, such as IED's. However, the manipulation of a robotic device to properly position MWB counter charges in relation to an IED can still be quite difficult and time consuming.

Carriers for bottles are known; however, they have not been designed or used specifically for the delivery of Mineral Water Bottle counter charges to an Improvised Explosive Device during render-safe procedures. Typical carriers have been designed to merely facilitate the carrying and transporting of bottles or other beverage containers.

For instance, U.S. Pat. No. 4,250,992 (Gilbert), discloses a beverage bottle carrier made from a one-piece blank of corrugated paperboard or the like which is folded into the desired form without the aid of additional attaching means (i.e. stitching, gluing, etc.). The carrier is in the form of a tray with a handle that divides the carrier into two equally sized carrying compartments. Therefore, although the Gilbert reference discloses the concept of having bottles disposed on either side of a carrier, Gilbert does not disclose any type of means for securely positioning the bottles in the carrier to prevent the movement thereof within the compartments. As well, although the carrier also includes a handle, the handle is not necessarily suited for engagement by a robotic arm or the like.

Canadian Patent Application No. 2,146,264 (Miret) discloses a bottle carrying device that includes a triangular base portion with an upwardly projecting handle portion. The triangular base portion includes cut-outs in the base portion and each of the sidewalls for receiving the neck of a bottle. The cut-outs in the sidewalls are adapted to engage the annular shoulder of the neck of the bottle, thereby securing the bottle in place. While Miret discloses a triangular shaped support structure that actively engages the bottles, the Miret device is not particularly suited to the delivery of MWB counter charges since the device does not provide any form of supporting base that would ensure the counter charges remain upright.

Canadian Patent Application No. 2,257,459 (Piotrowski) discloses a bottle pack container comprising two symmetrical carrying parts disposed about a central axis. The container is preferably made from cardboard or pasteboard, and has a central portion formed by superimposed central walls of the carrying parts, which are fastened together by a lock which forms a grip. Each carrying part also includes a bottom wall and an external wall. Extending between the central portion and the external wall of each carrying part is one or more support rings sized to receive a bottle. The support rings are foldably connected to their respective central wall, and have tabs projecting therefrom which are glued to the external wall during assembly of the container. The external walls of each carrying portion also include cut-outs therein for receiving a strap which secures the assembled container around the bottles. Once again, although this application discloses the concept of oppositely disposed bottle-carrying portions with means for supporting the bottles in place, the grip portion is not necessarily well-suited for engagement by a robotic arm.

SUMMARY OF THE INVENTION

The present invention provides a quick and user-friendly system that facilitates the deployment of Mineral Water Bottle counter charges. The invention comprises a delivery device designed to carry at least one MWB counter charge, by remote means, to a target Improvised Explosive Device during render-safe procedures. The delivery device is designed in such a way so as to provide automatic positioning of the MWB counter charges at the appropriate stand-off distance in relation to the IED, depending on the orientation of the device. As well, the delivery device is fully collapsible so as to facilitate the storage and transportation of the device.

Therefore, according to one aspect of the invention, there is provided a delivery device for carrying a Mineral Water Bottle counter charge that comprises an elongated tubular holding element having an opening defined in the upper portion thereof for receiving the MWB counter charge. The delivery device also includes a lifting strap connected to the holding element and aligned with the opening therein.

According to another aspect of the invention, there is provided a blank for forming a delivery device for carrying a Mineral Water Bottle counter charge, comprising a base panel, and two sidewall panels each being connected to a respective side edge of the base panel by a fold line. A cut-out section is defined in an outer edge of the sidewall panels. The blank further includes locking means for securing the sidewall panels in a triangular configuration once they have been folded towards each other relative to the base panel along the fold lines. Means are also provided in the base and side wall panels of the blank for securing a lifting strap to the delivery device.

According to a further aspect of the invention, there is provided a delivery device for carrying two Mineral Water Bottle counter charges comprising a central panel with an elongated tubular holding element disposed along each side edge of the central panel. An opening is defined in the upper portion of each holding element for receiving one of the MWB counter charges. The device further includes a lifting strap aligned with the openings and connectable to the holding elements and the central panel.

According to yet another aspect of the invention, there is provided a blank for forming a delivery device for carrying two Mineral Water Bottle counter charges comprising a generally rectangular central panel and two base panels, each being connected to a respective side edge of the central panel. A set of two sidewall panels are connected to a respective base panel along a side edge thereof by a fold line. Each sidewall of the set is connected to each other along a second fold line. The blank further includes a cut-out portion defined in each set of sidewall panels along the second fold line, and locking means for securing each set of sidewall panels in a triangular configuration with the respective base panel. The blank also includes means in the base panels and side panels for securing a lifting strap to the delivery device.

BRIEF DESCRIPTION OF THE DRAWINGS

The present invention will be better understood with reference to the detailed description taken in combination with the drawings in which.

DETAILED DESCRIPTION OF THE PREFERRED EMBODIMENTS

Figure 1:
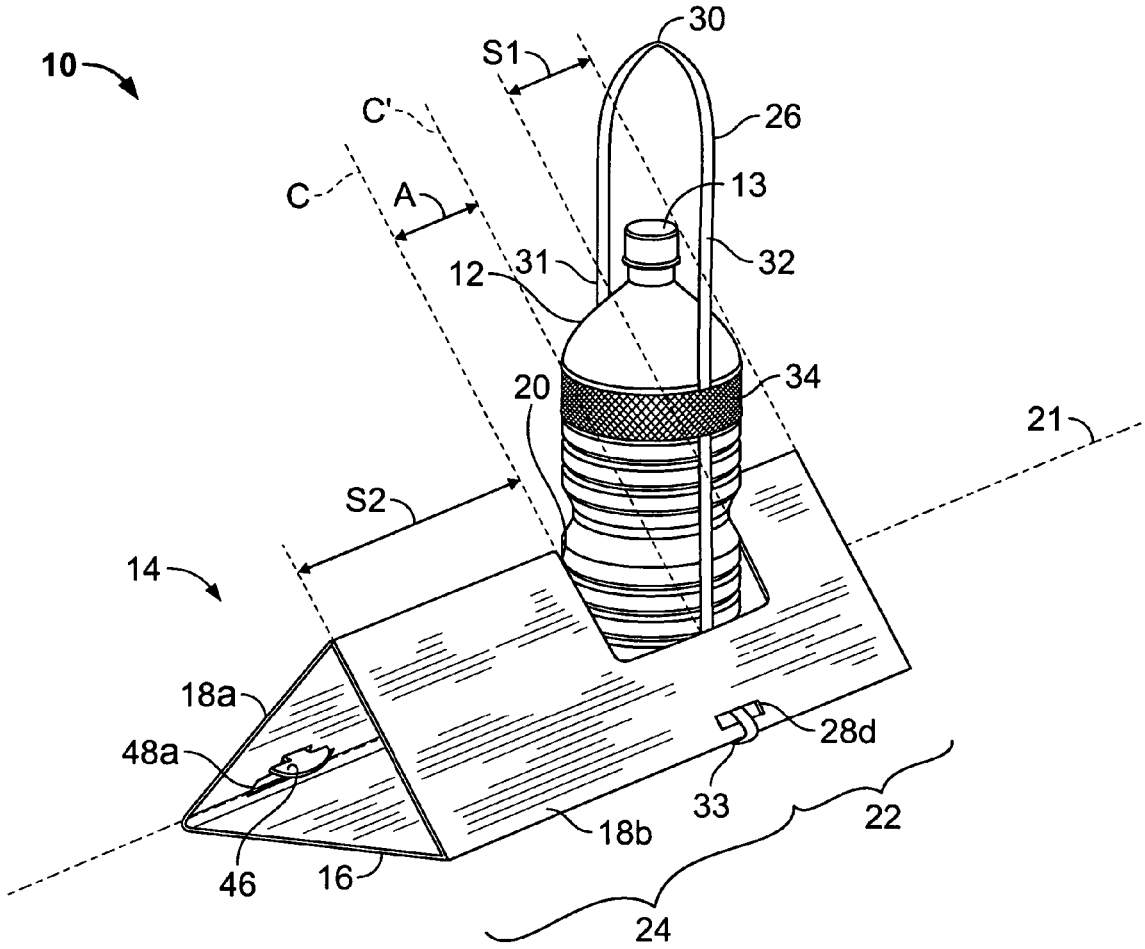
FIG. 1 is an isometric view of the delivery device adapted for holding one Mineral Water Bottle counter charge.
Figure 2:
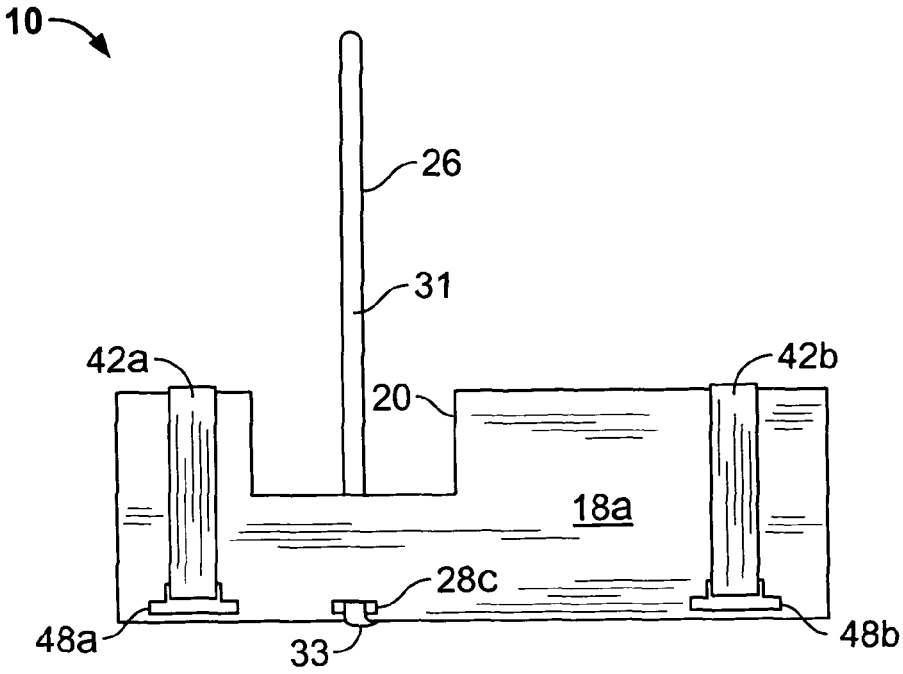
FIG. 2 is a side view of the delivery device of FIG. 1.

Referring to the drawings, there is shown in FIG. 1 a delivery device 10 for holding a Mineral Water Bottle counter charge 12. In practice, the MWB counter charge 12 is equipped with an explosive main charge that is housed in a plastic tube (not shown) that is inserted through the center of cap 13 of the MWB counter charge 12. At least one detonator (not shown) is positioned on top of the main charge inside the plastic tube and acts as the primary initiation means. The delivery device 10 is preferably made from corrugated plastic that can be die-cut as a blank and folded into the desired form. When designed for use with only one MWB counter charge, the assembled delivery device 10 comprises an elongated tubular holding element 14. As shown in FIG. 1, the elongated tubular holding element 14 is preferably triangular in shape having a base panel 16, and two sidewall panels 18a, 18b that angle towards each other creating the triangular configuration. The holding element 14 includes a cut-out portion 20 located along the upper portion of the triangular holding element 14 for receiving the MWB counter charge 12. The cut-out portion 20 is sized so as to create an interference fit with the MWB counter charge 12, thereby frictionally engaging the counter charge 12 in the holding element 14. The size and shape of the cut-out portion may vary in order to accommodate different sizes of counter charges. Typically, MWB counter charges come in 500 ml, 1.5 L or 2.6 L sizes.

The centre C' of the cut-out portion 20 is positioned offset from the centre C of the holding element 14 by a distance A along the longitudinal axis 21 thereof, thereby creating a shorter end portion 22 of the holding element 14 and a longer end portion 24 of the holding element 14, that correspond to first and second stand-off distances S1, S2 which are known to be effective for the disposal of Improvised Explosive Devices.

A lifting strap 26 is secured to the delivery device 10 to provide a form of carrying means for the device. The lifting strap 26 comprises a web of material with sufficient rigidity that it can substantially retain its form when lifting forces are not being exerted on the strap 26. The lifting strap 26 can, therefore, be made of a bendable plastic, wired fabric, or any other suitable material. The lifting strap 26 is secured to the delivery device 10 by threading an end of the web strap material through strategically positioned openings 28*a-d* in the sidewalls 18*a*, 18*b* and base 16 of the holding element 14, thereby creating a handle portion 30, two generally downwardly depending leg portions 31, 32 and a bottom portion 33. The ends of the web strap material are equipped with mating means such as a strap buckle, corresponding male and female components of a conventional tie-strap, or any other suitable means that allow the ends to be interlocked creating a closed loop secured to the delivery device 10.

The lifting strap 26 is positioned on the delivery device 10 so that the leg portions 31, 32 of the strap 26 are on either side of the MWB counter charge 12 in a plane generally perpendicular to the longitudinal axis 21 of the delivery device 10. The lifting strap 26 extends above the height of the MWB counter charge 12 so as to provide adequate clearance between the handle portion 30 of the lifting strap 26 and the top of the MWB 12. This ensures that the handle portion 30 can be readily grasped by any remote means, such as a mechanical arm of a robotic device.

In order to ensure that the MWB counter charge 12 is adequately secured in the delivery device 10, a securing strap 34 is provided which surrounds the MWB counter charge 12 and the leg portions 31, 32 of the lifting strap 26. The securing strap 34 may take the form of a piece of tape, a Velcro™ strap, a twist tie, or any similar means.

The structure of the delivery device 10 facilitates the proper placement of the MWB counter charge 12 at the appropriate stand-off distance from the target Improvised Explosive Device to ensure effective disposal of the IED due to the offsetting of the cut-out portion 20 an appropriate distance from the centre of the holding element 14. Therefore, when it is desirable to have the MWB counter charge 12 placed at the closer of the two stand-off distances to the target IED, the delivery device is oriented so that the shorter end 22 of the holding element 14 abuts the IED, which automatically places the counter charge 12 at the first predetermined stand-off distance S1 from the IED. When it is desirable to have the MWB 12 placed farther away from the IED, the delivery device is oriented in the opposite direction so that the longer end 24 of the holding element 14 abuts the IED, thereby positioning the counter charge 12 at the second predetermined stand-off distance S2 from the target. Therefore, when disposal of an IED is required, the operator of a robotic device can easily deliver the MWB counter charge 12 at either the first or second available stand-off distance to effectively dispose of the IED with minimal risk to the operator of the robotic device and any other person on scene at the time of the disposal.

Figure 3:
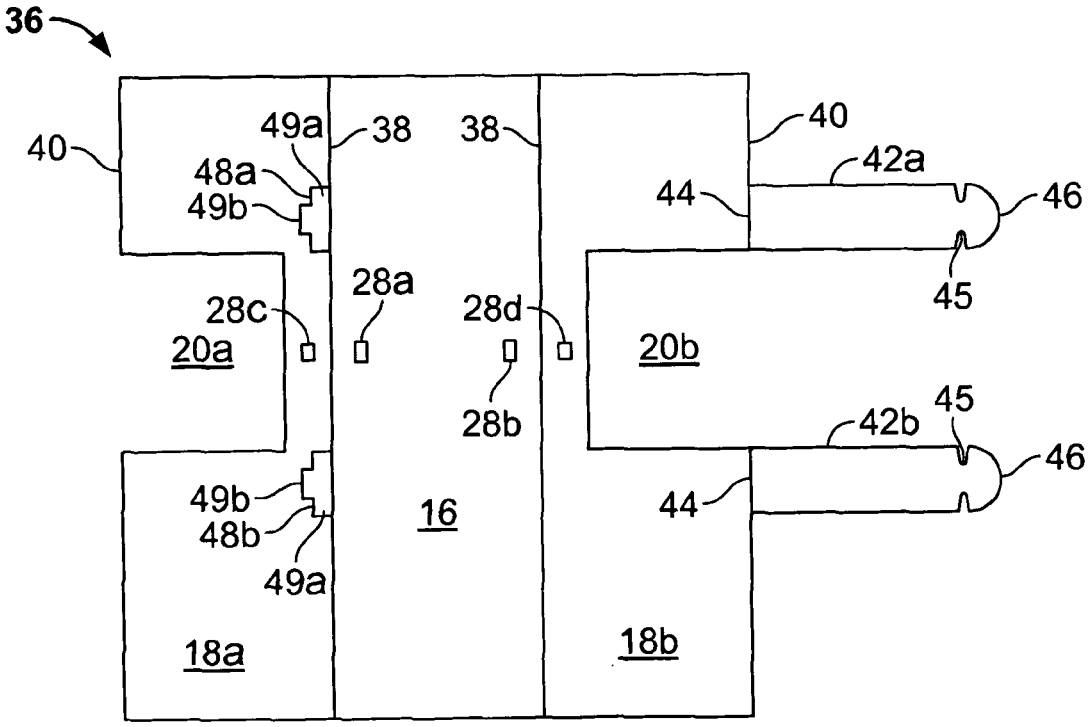
FIG. 3 is a plan view of a blank for forming the delivery device of FIG. 1.

A blank 36 for forming the delivery device 10 adapted for holding one MWB counter charge 12 is shown in FIG. 3. Centrally located in the blank 36 is base panel 16, which is connected by living hinges, score or fold lines 38 to sidewall panels 18*a*, 18*b*. The sidewall panels 18*a*, 18*b* define cut-out sections 20*a*, 20*b* which interrupt the outer edge 40 of the sidewall panels 18*a*, 18*b*. When the blank 36 is formed into the delivery device 10, the cut-out sections 20*a*, 20*b* come together to create the cut-out portion 20 in the triangular holding element 14. The cut-out sections may be generally rectangular in shape Two locking tabs 42*a*, 42*b* extend from the edge of sidewall panel 18*b* on either side of the cut-out section 20*b* adjacent the opening thereof. The locking tabs 42*a*, 42*b* are connected to the sidewall panel 18*b* by living hinge, score or fold lines 44. The distal end of each of the locking tabs 42*a*, 42*b* has a locking head 46 attached thereto by a neck portion 45 which is narrower in width than the locking tab itself. The sidewall panel 18*a* that does not include the locking tabs 42*a*, 42*b* instead includes two T-shaped slots 48*a*, 48*b*, with one located on either side of the cut-out section 20*a* proximal the fold line 38 connecting the sidewall panel 18*a* to the base panel 16. Each slot has a first section 49*a* of a width to receive the locking head 46 of the corresponding tab 42*a*, 42*b*, and a second section 49*b* of a width to frictionally receive the neck portion 45 thereof.

In order to assemble the delivery device 10 from the blank 36, sidewall panels 18*a*, 18*b* are folded upwards, relative to base panel 16, along fold lines 38. Locking tabs 42*a*, 42*b* are then folded along lines 44 and are directed over the opposite sidewall panel 18*a* towards the base thereof. Locking heads 46 are then folded inwards along the neck portion 45 and are inserted in the first section 49*a* of the corresponding T-shaped slot 48*a*, 48*b*. The locking heads 46 are then pushed into engagement with the second stem section 49*b* of the T-shaped slots 48*a*, 48*b* so that the neck portions 45 become frictionally engaged therein, thereby securing the sidewall panels 18*a*, 18*b* of the holding element 14 in the desired triangular configuration.

The blank 36 also includes a series of die-cut openings 28*a-d* through which the lifting strap 26 is threaded and secured to the delivery device 10. The base panel 16 has aligned openings 28*a*, 28*b* slightly spaced from fold lines 38 and in line with the centre of the cut-out sections 20*a*, 20*b*. The sidewall panels 18*a*, 18*b* include openings 28*c*, 28*d* positioned opposite to, and in alignment with, the corresponding openings 28*a*, 28*b* in the base panel 16 across fold line 38. When the blank 36 is assembled to form the delivery device 10 and the lifting strap 26 is attached thereto, the leg portions 31, 32 of the lifting strap extend into the cut-out portion 20 of the triangular holding element along the edges thereof and out through the openings 28*c*, 28*d* near the base of the sidewall panels 18*a*, 18*b*. The strap 26 then folds around the bottom edges of the holding element 14 created by fold lines 38, and enters the holding element 14 through the openings 28*a*, 28*b* in the base panel 16, and spans the floor of the holding element 14. The threading of the lifting strap 26 through the series of openings 28*a-d* in the base panel 16 and sidewall panels 18*a*, 18*b* of the delivery device 10 creates a secure and balanced lifting strap 26 for the delivery device 10. Alternatively, rather than having the lifting strap 26 span the floor of the holding element 14 through openings 28*a*, 28*b*, the lifting strap can simply traverse the base of the holding element 14 on the exterior thereof once it has exited the holding element 14 through openings 28*c*, 28*d*. This can facilitate the manufacturing of the blank for the delivery device 10 since only two strap openings are required.

Figure 3A:
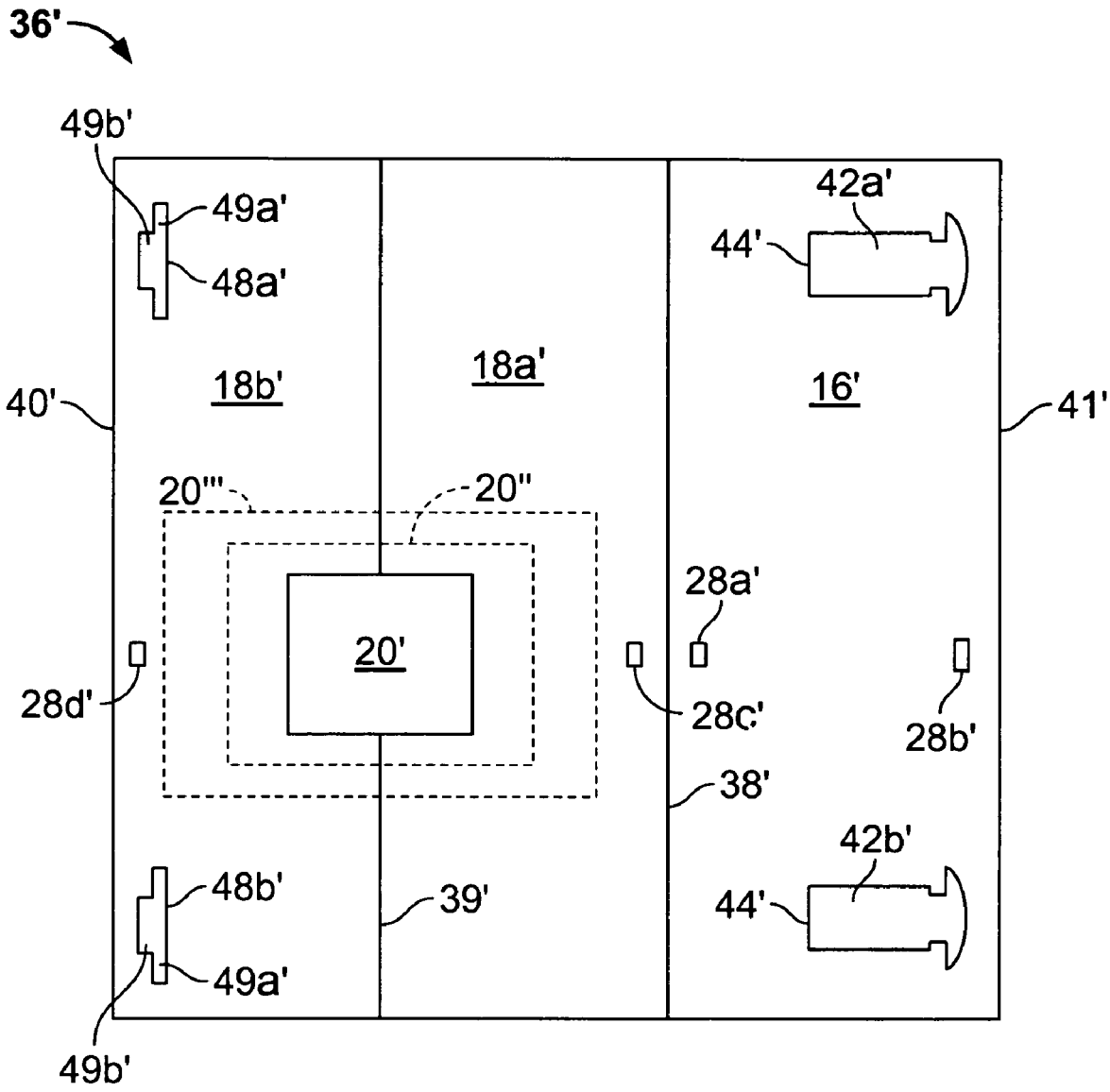
FIG. 3*a* is a plan view of a blank for forming a delivery device adapted for holding one Mineral Water Bottle counter charge according to another embodiment.

FIG. 3*a* shows an alternate blank 36' that may be used to create the delivery device for carrying one Mineral Water Bottle counter charge. In this embodiment, the blank 36' still comprises three panels, however, the sidewall panels 18*a*', 18*b*' are positioned adjacent each other in series along fold line 39' with the base panel 16' positioned adjacent sidewall panel 18*a*' along fold line 38'.

In order to easily accommodate different sized MWB counter charges, multiple cut-out portions 20', 20", 20'". are formed in the middle of the two sidewall panels 18*a*', 18*b*' along fold line 39' offset from the centre of the delivery device 10 along the longitudinal axis 21 thereof. Cut-out portions 20" and 20'" are created by perforated lines so that the excess material can be removed to form the desired opening when one of the large sized MWB counter charges is used.

As well, rather than having locking tabs extend from the outer edge of one of the side wall panels, the locking tabs 42*a*', 42*b*' are embedded in the base panel 16' of the blank 36'. The locking tabs 42*a*', 42*b*' are attached to the base panel 16' along fold line 44', the remaining edges of the locking tabs 42*a*', 42*b*' being free to lift out of the plane of the base panel 16'.

When blank 36' is folded into the desired configuration, the sidewall panel 18*b*' is folded relative to panel 18*a*' along line 39' which creates the apex of the triangular holding element.

Panel 18*a*' is folded relative to base panel 16' along fold line 38' which brings the outer edge 40' of panel 18*b*' proximal the edge 41' of the base panel 16'. The locking tabs 42*a*', 42*b*' are pressed out of the plane of base panel 16' and are pushed into engagement with the corresponding T-shaped slots 48*a*', 48*b*' in sidewall panel 18*b*' thereby consolidating the triangular configuration of the holding element 14. The lifting strap 26 can then be secured to the holding element 14 in a similar manner as described for the embodiment shown in FIG. 3.

According to the embodiment shown in FIG. 3*a*, the T-shaped slots 48*a*', 48*b*' are oriented so that the larger first section 49*a*' of the T-shaped slots is spaced away from the outer edge of sidewall panel 18*b*' with the second stem section 49*b*' located proximal the edge of the sidewall panel 18*b*'. This configuration has been found to be advantageous when the locking tabs are located in the base panel 16', although the T-shaped slots will also function in the reverse position, as shown in FIG. 3, without any significant effect on the structure of the delivery device 10.

Figure 4:
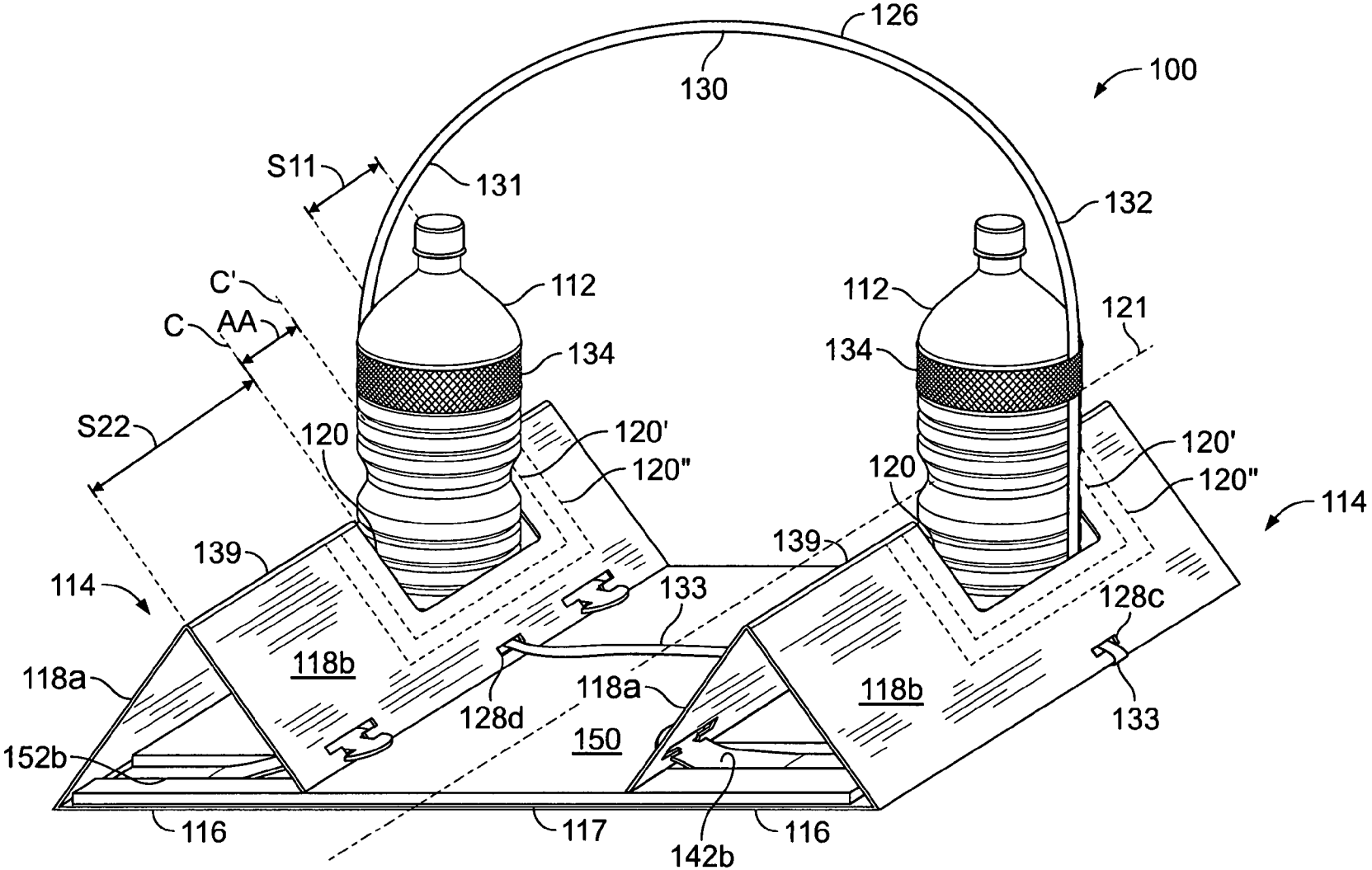
FIG. 4 is an isometric view of a delivery device adapted for holding two Mineral Water Bottle counter charges.

The delivery device may also be adapted for use with more than one Mineral Water Bottle counter charge, as shown in FIG. 4. When two MWB counter charges are required to dispose of an Improvised Explosive Device, the delivery device 100 comprises two elongated triangular holding elements 114 disposed along opposite sides of a rectangular central panel 117. Each of the holding elements 114 comprises a base panel 116 and two sidewall panels 118*a*, 118*b*. Each of the holding elements 114 includes a cut-out portion 120 in the triangular upper portion thereof for receiving a MWB counter charge 112. As with the single MWB counter charge delivery device 10, the cut-out portions 120 are offset from the centre of the delivery device 100 by a distance AA along the longitudinal axis 121 thereof so as to create a first stand-off distance S11 with the length of one end 122 of the delivery device 100 and a second stand-off distance S22 with the length of the other end 124 of the delivery device 100.

When using two MWB counter charges 112, an additional reinforcing panel 150 may be required, depending on the strength and thickness of the material used for the device, to prevent the delivery device 100 from folding, bending, or collapsing with the additional weight of the two MWB counter charges 112. When the reinforcing panel 150 is being used, it is positioned over the central panel 117 and a portion of each of the adjacent base panels 116 of the delivery device 100. Therefore, a substantial portion of the base of the delivery device 100 is of at least double thickness which ensures that the base of the device has sufficient strength to support the weight of the MWB counter charges. However, if the material forming the delivery device 100 is sufficiently rigid, then the reinforcing panel 150 is not required.

A lifting strap 126 is secured to the double delivery device 100 in a similar manner to that used for the singular delivery device 10. The lifting strap 126 has a handle portion 130, two downwardly depending leg portions 131, 132, and a base portion 133 that is threaded through similarly positioned openings 128*a-e* in the base panel 116 and sidewall panels 118*a*, 118*b* of each of the holding elements 114. Additional securing straps 134 may also be used in order to ensure that the Mineral Water Bottle counter charges 112 are positioned securely in the delivery device 100. Although the threading of the lifting strap 126 through openings 128*a-e* is preferred since it provides additional stability and additional securing of the holding elements 114 in the triangular configuration, as mentioned above, it is not essential to the functioning of the delivery device. As with the single Mineral Water Bottle delivery device 10, the base portion 133 of the lifting strap 126 for the double MWB delivery device 100 can simply traverse the bottom of the delivery device 100 on the exterior thereof without being threaded through openings 128*a*, 128*b*, 128*d*, 128*e*.

Figure 5:
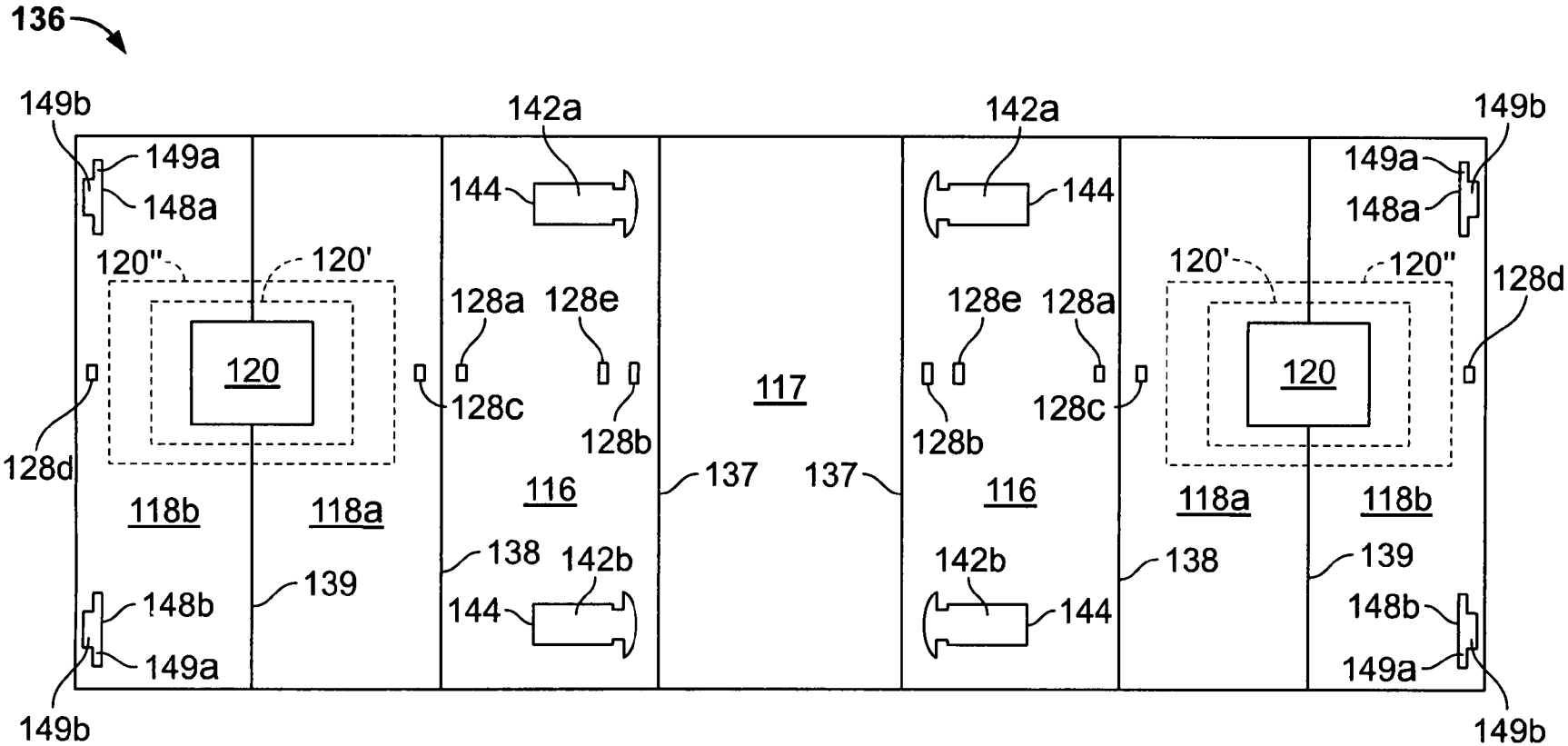
FIG. 5 is a plan view of a blank for forming the delivery device of FIG. 4.

A blank 136 for forming the delivery device 100 for carrying two Mineral Water Bottle counter charges 112 is shown in FIG. 5. Centrally located in the blank 136 is central panel 117. Adjacent the central panel 117 are the base panels 116 of each of the triangular holding elements 114. The base panels 116 are distinguished from the central panel 117 by reference or connection lines 137. Adjacent each of the base panels 116 are the two sidewall panels 118*a*, 118*b* for each holding element 114, which are separated from the base panel 116 and from each other by score or fold lines 138 and 139, respectively, which act as living hinges. Fold lines 139 serve as the apex of the triangular holding elements 114 once the blank 136 has been folded into the final configuration. Fold lines 138 create the outer edges/corners of the triangular holding elements 114 when the blank 136 is configured to form the delivery device 100.

Fold lines 139 are each interrupted by multiple concentric cut-out sections 120, 120', 120" which provide an opening in each triangular holding element 114 for receiving a MWB counter charge 112. Cut-out sections 120' and 120" are created by perforated lines around the central opening 120 so that when a larger opening for the MWB counter charge is required, the excess material can be easily removed. As with the single MWB counter charge delivery device 10, the cut-out sections 120 are positioned offset from the centre of the delivery device 100 along the longitudinal axis 121 thereof, thereby creating the first and second stand-off distances S11, S22.

The base panels 116 have locking tabs 142*a*, 142*b* die-cut therein, with each locking tab positioned adjacent a respective end edge of the base panel 116. The locking tabs 142*a*, 142*b* are connected to the base panel at fold lines 144, and the remaining edges of the locking tabs 142*a*, 142*b* are defined by cut lines which allow the locking tabs 142*a*, 142*b* to be pushed out of the plane of the base panels 116.

The outermost panels of the blank 136 are sidewall panels 118*b* for each holding element 114. The sidewall panels 118*b* include T-shaped slots 148*a*, 148*b* located along the outer edge of the sidewall panels 118*b* and positioned so as to correspond with the locking tabs 142*a*, 142*b* located in the base panels 116. When the delivery device 100 is folded into the desired configuration, the locking tabs 142*a*, 142*b* are brought into engagement with the T-shaped slots 148*a*, 148*b* in the sidewall panels 118*b*, so as to secure the holding elements 114 in the desired triangular configuration. According to the preferred embodiment, the T-shaped slots 148*a*, 148*b* are oriented so that the larger first section 149*a* of the T-shaped slot is oriented away from the outer edge of sidewall panels 118*b*, thereby positioning the second stem section 149*b* proximal the edge of the sidewall panel 118*b*. However, the T-shaped slots 148*a*, 148*b* will also function appropriately in the reverse position without any significant effect on the structure of the triangular holding elements 114.

As with the single MWB counter charge delivery device 10, the blank 136 for the double MWB counter charge delivery device 100 includes a series of strategically placed openings 128*a-e* through which the lifting strap 126 is threaded. Openings 128*c*, 128*d* are located on either side of the cut-out portion proximal the bottom of each sidewall panel 118*a*, 118*b* of each holding element 114. Strap openings 128*a*, 128*b* are also located in each of the base panels 116, with one opening 128*a* located opposite the opening 128*d* in the innermost sidewall panel 118*b* across fold line 138, and the other opening 128*b* being located proximate to reference line 137 in line with opening 128*a*. A third opening 128*e* is also located in each base panel 116 and is parallel to and slightly inside from opening 128*b*.

Figure 6:
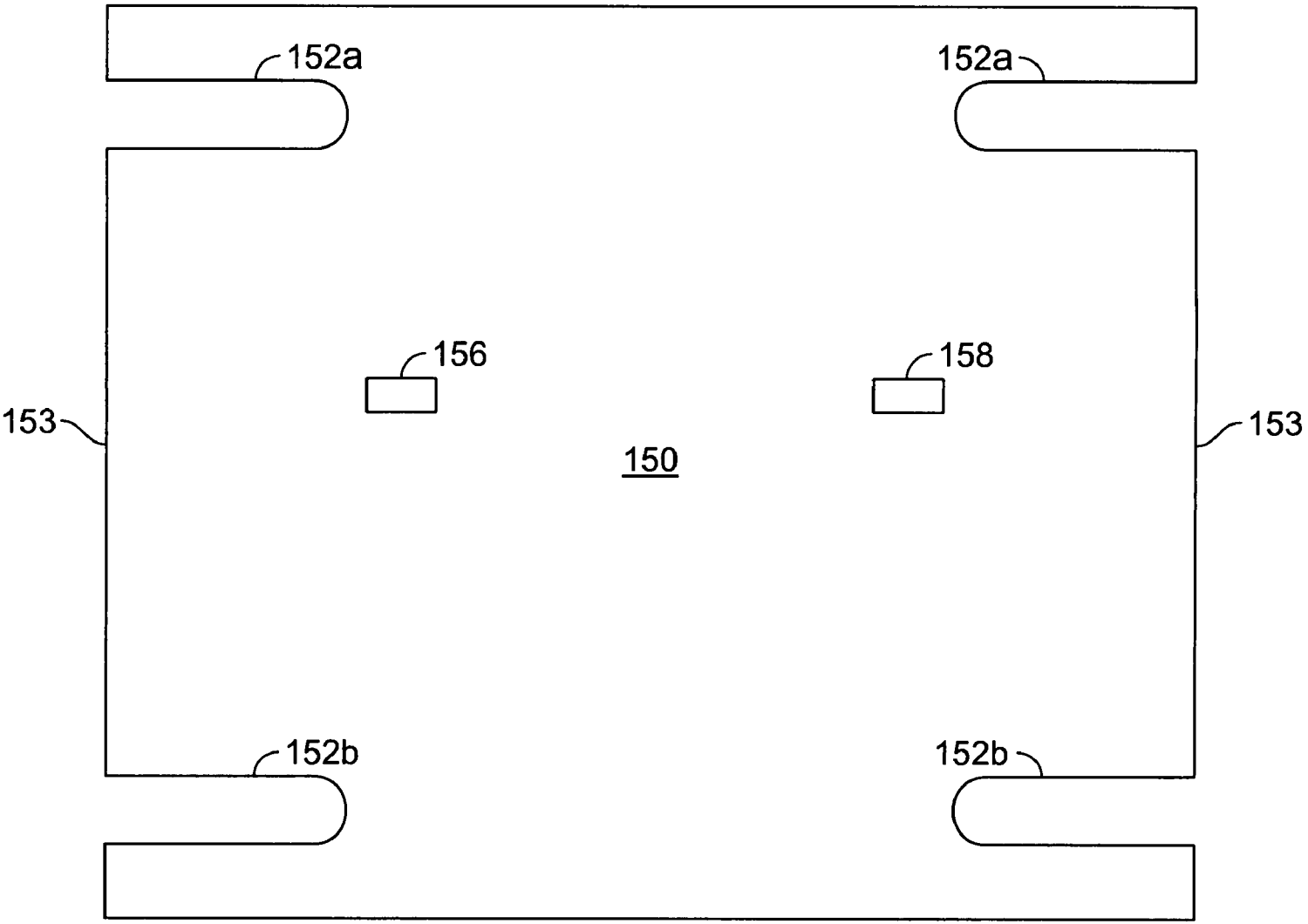
FIG. 6 is a plan view of a reinforcing panel for use with the blank of FIG. 5.

Reinforcing panel 150 (see FIG. 6) may be used in conjunction with the blank 136 to create the double MWB counter charge delivery device 100. The reinforcing panel 150 is sized so as to cover the central panel 117 and the majority of the two base panels 116. Therefore, the reinforcing panel 150 overlaps a portion of the blank 136 so that the majority of the base of the delivery device 100 is a two-ply structure. Slots 152*a*, 152*b* are cut out along the outer edges 153 of the reinforcing panel 150 at each end thereof, corresponding to the position of the locking tabs 142*a*, 142*b* in base panels 116. The slots 152*a*, 152*b* allow the locking tabs 142*a*, 142*b* to engage with the T-shaped slots 148*a*, 148*b* without any interference from the reinforcing panel 150. The reinforcing panel 150 also includes two openings 156, 158, which when in place over the blank, overlap openings 128*b*, 128*e* in the base panels 116 so as not to interfere with the threading of the lifting strap 126 through the base of the delivery device 100.

The blank 136 can also be formed without openings 128*a*, 128*b*, 128*d*, 128*e* since the lifting strap 126 can simply be threaded around the bottom of the delivery device 100 as mentioned above. When such a blank is used in conjunction with a reinforcing panel, the reinforcing panel 150 does not need openings 156, 158 since the lifting strap 126 remains on the outside of the delivery device 100.

In order to form the double Mineral Water Bottle counter charge delivery device 100, the reinforcing panel 150 is placed in position on the blank 136. Sidewall panels 118*b* are folded along fold lines 138 and the apex of the triangular holding elements 114 is created as sidewall panels 118*a* are folded along lines 139. Locking tabs 142*a*, 142*b* are then lifted through the slots 152*a*, 152*b* in the reinforcing panel 150 and engage the T-shaped slots 148*a*, 148*b* in the sidewall panels 118*b*. Once the triangular holding elements 114 have been configured, the lifting strap 126 can be secured to the delivery device 100. An end of the lifting strap is inserted through one of the cut-out portions in one of the holding elements along the outer edge thereof. The strap then exits the opening 128*d* in the sidewall panel and bends around the outer corner of the device created by fold line 138. The strap is then inserted through the corresponding opening 128*a* in the base panel, spanning the width thereof over the top of the reinforcing panel 150, until exiting again at the first of the two openings, 128*e*, located on the other side of the base panel 116. The strap enters the second of the two openings 128*b*, and then exits the triangular holding element through the opening 128*d* in sidewall panel 118*b*. The strap 126 then spans the width of the central panel 117 over top of the reinforcing panel 150 and goes through the same series of threading through the openings 128*a-e* in the other triangular holding element until the ends of the lifting strap 126 meet, creating a closed loop with a handle portion 130 and two leg portions 131, 132.

One of the advantages of using the blank 136 adapted for use with two Mineral Water Bottle counter charges is that it can be easily modified for use with a single such counter charge. By cutting along reference lines 137 on either side of the central panel 117, blank 136 is transformed into two blanks, according to the embodiment shown in FIG. 3*a*, for forming single MWB counter charge delivery devices. This modification can easily be done in the field as required, making the blank 136 quite versatile.

While the present invention has been described with respect to certain preferred embodiments, it will be understood by persons skilled in the art that variations or modifications can be made without departing from the scope of the invention as described herein.

What is claimed is:

1. A Mineral Water Bottle (MWB) counter charge delivery device usable in the disposal of an explosive device, comprising:

an MWB counter charge;

a tubular holding element, generally triangular in transverse cross-section and having an elongated base panel and a pair of elongated sidewall panels sloping upwardly and inwardly from outer edges of said base panel;

a generally transverse opening in an upper portion of said holding element in which the MWB counter charge is received, said opening being formed partially in each sidewall panel;

said opening being sized for frictionally engaging an outer wall of the MWB counter charge when said MWB counter charge is received therein; and a narrow lifting strap centrally aligned with said opening, extending transversely of and connectable to said holding element.

2. The delivery device according to claim 1, wherein said opening is longitudinally offset from the centre of said holding element thereby defining a first end portion of said holding element corresponding to a first stand-off distance, and a second end portion of said holding element corresponding to a second stand-off distance.

3. The delivery device of claim 1, wherein said opening is generally rectangular.

4. The delivery device according to claim 1, further including means for securing the MWB counter charge to said lifting strap.

5. The delivery device according to claim 4, wherein said means for securing comprises a strap which during use of said delivery device will surround both the MWB counter charge and said lifting strap to prevent movement therebetween.

6. A blank from which a holding element of a Mineral Water Bottle (MWB) counter charge delivery device, for carrying an MWB counter charge usable in the disposal of an explosive device, may be formed, comprising:

an elongated generally rectangular base panel;

a pair of elongated generally rectangular sidewall panels, each sidewall panel being connected to a respective side edge of said base panel by a fold line;

a cut-out section defined in an outer edge of each of said sidewall panels for creating an opening for receiving the MWB counter charge when said blank is formed into said holding element;

locking means for securing said sidewall panels in a triangular configuration with said base panel once they have been folded upwardly and inwardly towards each other relative to said base panel along said fold lines; and means for securing a lifting strap to said holding element in central alignment with said cut-out sections.

7. The blank according to claim 6, wherein said locking means comprises:

a pair of locking tabs projecting from the outer edge of one of said sidewall panels, each locking tab being positioned adjacent to said cut-out section of said one sidewall panel, on either side thereof, and being connected to said one sidewall panel by means of a fold line;

a locking head disposed at the distal end of each locking tab; and a pair of locking slots formed in the other of said sidewall panels for receiving and retaining the locking head of a respective locking tab thereby maintaining said sidewall panels in a triangular configuration with said base panel when the blank is formed into the holding element.

8. The blank according to claim 6, wherein each cut-out section is longitudinally offset from the centre of its respective sidewall panel by a corresponding distance.

9. The blank according to claim 7, wherein each cut-out section is longitudinally offset from the centre of its respective sidewall panel by a corresponding distance.

* * * * *